US005092549A

United States Patent [19]

Beech

[11] Patent Number: 5,092,549

[45] Date of Patent: Mar. 3, 1992

[54] INFANT BOTTLE HOLDER ATTACHMENT DEVICE FOR INFANT SUPPORT

[76] Inventor: Ida Beech, P.O. Box 63458, Washington, D.C. 20029

[21] Appl. No.: 520,897

[22] Filed: May 9, 1990

[51] Int. Cl.[5] ..... A47C 9/00

[52] U.S. Cl. ..... 248/103; 248/231.7; 248/124; 297/188

[58] Field of Search ..... 248/102-107, 248/231.7, 286, 284, 124, 324; 297/188, 194

[56] References Cited

U.S. PATENT DOCUMENTS

| | | | |
|---|---|---|---|
| 712,184 | 10/1902 | Feld . | |
| 1,030,744 | 6/1912 | Neumann | 248/102 |
| 1,900,691 | 3/1933 | Carlson | 248/102 |
| 3,251,626 | 5/1966 | Martin | 297/188 |
| 3,258,291 | 6/1966 | Ezquerra et al. . | |
| 3,539,140 | 11/1970 | Tuttle | 248/104 |
| 3,635,431 | 1/1972 | Mariner | 248/104 |
| 4,121,797 | 10/1978 | MacNeil . | |
| 4,315,654 | 2/1982 | Crook . | |
| 4,813,739 | 3/1989 | Miller . | |

FOREIGN PATENT DOCUMENTS

| | | | |
|---|---|---|---|
| 140990 | 4/1951 | Australia | 248/103 |
| 532910 | 11/1956 | Canada | 248/103 |
| 187972 | 8/1907 | Fed. Rep. of Germany | 248/103 |
| 352428 | 8/1905 | France | 248/102 |
| 570140 | 12/1975 | Switzerland | 248/103 |

OTHER PUBLICATIONS

After the Stork, Spring/Summer 1989 catalog.

*Primary Examiner*—Karen J. Chotkowski
*Attorney, Agent, or Firm*—Pennie & Edmonds

[57] ABSTRACT

A device for attaching a bottle holder and the like is removably and adjustably attached to an infant support, which includes an infant seat and infant car seat. The device includes a plurality of bars, the bars being pivotally attached to each other to form a generally inverted U-shape. The free ends of the inverted U-shape bars are clamped to the sides of the support by a pair of clamps. The clamps are readily attachable and detachable to any infant support regardless of the size variations. The pivotally inverted U-shape bars permit the distance between the bars having the free ends to be laterally adjustable in a parallel manner to accommodate for the variations in widths of different infant supports.

17 Claims, 3 Drawing Sheets

INFANT BOTTLE HOLDER ATTACHMENT DEVICE FOR INFANT SUPPORT

BACKGROUND OF THE INVENTION

1. Field of the Invention

This invention relates to a device for mounting a feeding bottle holder, toy holder, and the like, the device being detachably attached to an infant support or an infant car seat, and the like.

2. Description of the Prior Art

A device for mounting a feeding bottle holder, toy holder, and the like has been proposed, for example, in U.S. Pat. Nos. 712,184 to Feld, 4,121,797 to MacNeil, 4,315,654 to Crook, and 4,813,739 to Miller.

U.S. Pat. No. 712,184 to Feld discloses a device for mounting a bottle holder to a baby carriage. The mounting device comprises three spring arms, each arm having a hook at one end thereof configured to engage and rest on one side of the carriage. The other ends of the three spring arms are attached to a bottle holder. The Feld patent mounting device does not securely clamp on the carriage. Rather, the three hooks merely rest on the corresponding three sides of the carriage. Further, no means are provided for mounting the device to different types of carriages having different dimensions.

U.S. Pat. 4,121,797 to MacNeil discloses a device for mounting a bottle holder to an infant seat or support. The mounting device comprises a rod having two mounting ends, each having a groove. The infant support has a pair of triangular mounting ends, each having a recess to engage the groove of the rod. The MacNeil patent provides no means for adjustably mounting the device to different carriages having different widths. Further, the support requires a special mounting members integral thereto in order to mount the device.

U.S. Pat. No. 4,315,654 to Crook discloses a device for mounting a bottle holder to an infant seat. The device comprises a generally U-shaped legs attached to the sides of the seat. In order to mount the device to the seat, a pair of swivel clamps and bolts is needed. Specifically, a pair of holes must be drilled into the seat to accommodate the bolts. Further, no means are provided for adjustably mounting to different carriages having different widths.

U.S. Pat. No. 4,813,739 to Miller discloses a device for mounting a sun visor to an infant car seat. The device comprises a pair of rods, each rod having a pair of ends. One end of each rod is attached to the seat and the other end of each rod is attached to the sun visor. To mount the device to the seat, a pair of special mounting means are integrally built into the seat s that the position of the sun visor can be adjusted. Further, no means are provided for adjustably mounting the device to different seats having different widths.

There is no disclosure in the prior inventions for adjustably and detachably mounting a device for mounting a bottle holder and the like to different infant supports having different widths or dimensions.

SUMMARY OF THE INVENTION

The present invention comprises a bottle holder and a device for mounting the bottle holder and the like to an infant support, including an infant seat, an infant car seat, and the like. The device is adjustable to accommodate different sized infant supports and is also detachably mounted to the infant support. More specifically, the device is detachable from the support so that the same device can be used in another infant support. For example, the device can be removed from an infant seat and the same device can be attached to an infant car seat regardless of the size differences.

The device comprises a pair of clamps adapted to clamp onto the sides of the support, the clamp being adapted to accommodate various types of commercially available infant supports. Moreover, the position of the bottle holder is adjustable so that the bottle can be adjusted to accommodate different sized infants. The bottle holder and the like is detachably and slidably mounted relative to the device so as to accommodate various types of bottle holder and the like.

Accordingly, the object of the invention is to provide a device for mounting a bottle holder and the like in detachable manner to an infant support so that the device can be quickly attached to and detached from the support.

Another object of the invention is to provide a device which is adjustably mounted to the support so that the same device can be used in different infant supports having different dimensions.

Another object of the invention is to provide a bottle holder and the like which is slidable relative to the device so as to center the holder and the like relative to an infant.

Another object of the invention is to provide a device with means for positioning the bottle holder and the like relative to an infant to accommodate for various sized infants.

Another object of the invention is to provide a device with a foldable feature to accommodate for storage purposes.

My invention and features and advantages of my invention will be better appreciated from the following description.

DETAILED DESCRIPTION OF THE PREFERRED EMBODIMENT

Figure 1:
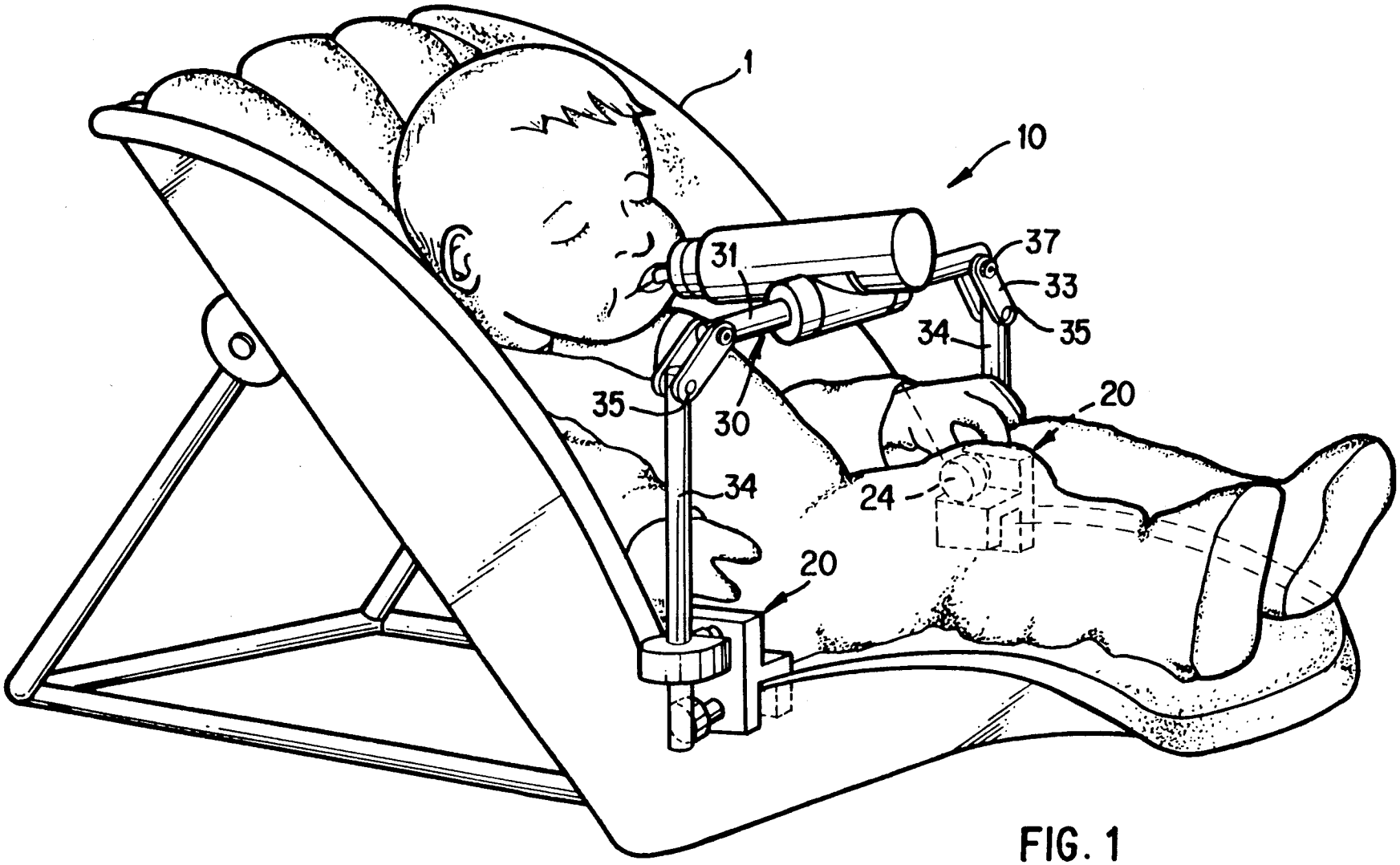
FIG. 1 is a perspective view of an infant support, which can be an infant seat or an infant car seat, and the like, showing a bottle holder and a device for mounting the bottle holder to the support.

FIG. 1 shows a conventional infant support (1), including any commercial infant seat or infant car seat. The support (1) generally holds an infant in a reclining position. Attached to the support (1) is a device (10) for mounting a bottle holder (40). This device (10) includes a pair of clamp means (20) which is attachable to the sides of the support (1) and a generally inverted U-shape bottle holder supporting frame means (30).

Figure 2:
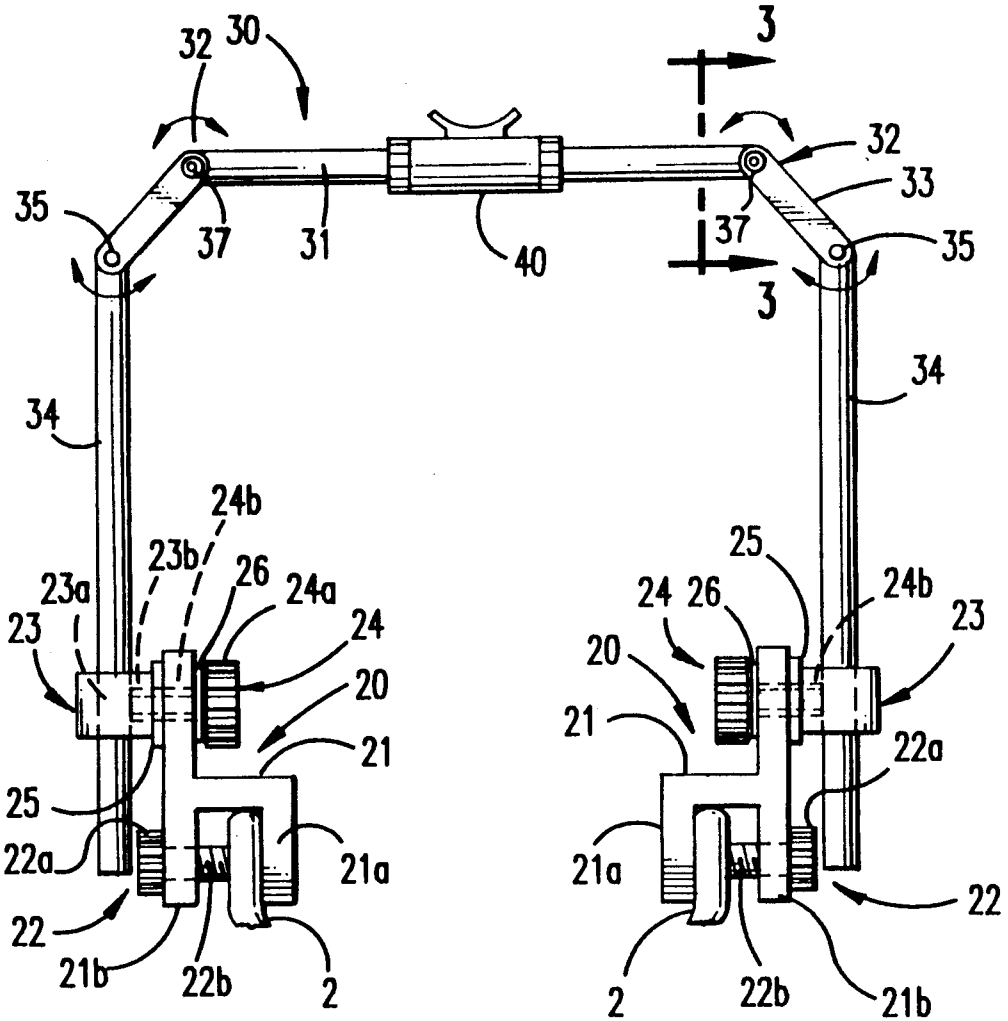
FIG. 2 is a front elevation view of the mounting device and the bottle holder.

FIG. 2 shows a front view of the supporting frame means (30) which includes a plurality of bars (31, 33, 34), which can be Circular or rectangular in cross section, pivotally joined to each other to form a generally inverted U-shape support frame for the bottle holder (40). In the present embodiment the bars are circular in cross section. A central bar means (31) has a pair of end joints (32), each joint having a pair of flat faces (32*a*, 32*b*) as shown in FIG. 3A. A pair of connecting plate members (33) pivotally connects to each end joint (32) of the central bar means (31). More specifically, one plate member (33) of the pair contacts one face (32*a*) and the other plate member (33) contacts the other face (32*b*) so as to sandwich the central bar member between the plate members (33). While the present invention utilizes a pair of plate members (33), only one plate member (33) is really needed. The extra plate member adds rigidity to the supporting frame means (30). Moreover, the connecting member (33) need not be plates as any type of conventional linkage means can be used for pivotally connecting the central bar means (31) and the two side bars (34) in a manner that enables the distance between the side bars (34) to be adjustable.

Figure 3:
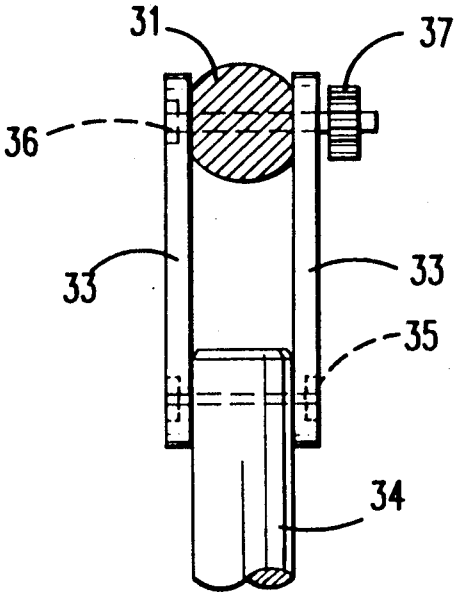
FIG. 3 is a detailed side elevation view of a pivotal joint section 3—3 of FIG. 2.
Figure 3A:
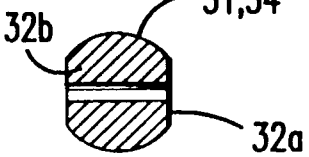
FIG. 3A is an end view of a joint section showing two contact surfaces.

A pair of side bars (34) is pivotally connected to the connecting members (33) in the identical manner as the central bar means (31) as shown in FIGS. 2 and 3. To form a rigid supporting frame means (30), at least any two of the four pivotal connections must be lockable. The other two pivotal connection can be freely pivotal. The freely pivotal joints can be accomplished with pins (26) in a conventional manner. To make the other two joints lockable a pair of bolts (36) and manually operable conventional knobs (37) is used in a conventional manner. Specifically, a bolt is aligned with holes in the plate members (33) and the central bar means (31) or the side bar (34). A knob or similar conventional tightening means (37) having a corresponding threaded hole is used to lock the joints from pivoting. By fixing any two joints and the ends of the side bars in a pair of clamp means (20), the bars (31, 33, 34) form a rigid inverted U-shape supporting frame means (30). This is a well known linkage principle. Therefore, detailed explanation is not deemed to be necessary.

Moreover, because all the joints are completely pivotal, the side bars (34) can be folded. For example, by loosening the two knobs (37), one of the two side bars can be tucked right underneath, in parallel with the control bar means (31). The other side bar (34) can be tucked on top of the control bar means (31). Furthermore, all four pivotal connections can have lockable features. By locking all four pivotal connections in a tucked position, the frame means (30) will maintain in the tucked position which is convenient for carrying the device.

Figure 4:
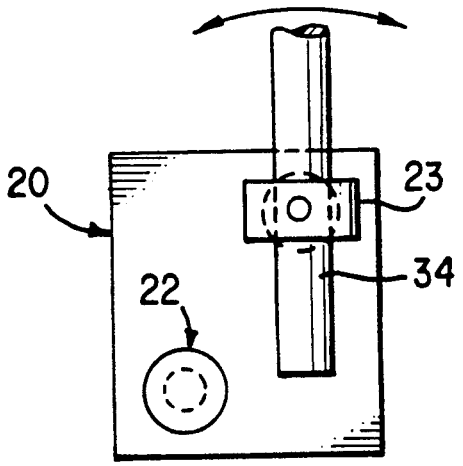
FIG. 4 is a side elevation view of a clamp means of the device.

FIGS. 2 and 4 show clamping means (20) adapted to clamp onto the sides (2) of the infant support (1) to stably lock the side bars (34) thereto in a manner as shown in FIG. 2. Specifically, the clamping means (20) includes a generally h-shaped body (21) having a pair of legs (21*a* and 21*b*). The pair of legs is straddled over the sidewall (2) of the support (1) as shown in FIG. 2. A locking means (22) having a knob (22*a*) and a threaded shaft (22*b*) integral thereto is threaded into the leg (21*b*) to securely lock the body (21) onto the sidewall (2). Any other conventional clamping means could also be expediently used for the same purpose of locking the side bars onto the sidewalls (2) of the support (1). Note that the locking means (22) should be tightened enough only to stably hold the frame means (20) when using in an infant car seat. This will permit the entire device, including the clamping means (20), to be disengaged from the car seat when an infant bangs sufficiently hard against the frame means (30) to prevent injury to the infant.

The side bars (34) are adjustably secured to the body (21) of the clamping means (20) by a mounting ring (23) having an opening (23*a*) for sliding the side bar (34) therein and a threaded tightening means (24) having a knob (24*a*) and a threaded shaft (24*b*) integral thereto. The ring (23) has a threaded hole (23*b*) permitting the shaft (24*b*) to be mated thereto. Between the ring (23) and the body (21), a washer (25) is preferably used. Likewise, between the knob (24) and the body (21) another washer (26) is preferably used.

By placing the side bar in the hole (23*a*) and tightening the knob (24*a*), the bar (24) is secured to the body (26). Moreover, the ring is rotatable when the knob (24*a*) is loosened, thereby enabling the ring and the side bars (24) to rotate as indicated by the double-headed arrows in FIG. 4. This enables the whole support means (30) and the rings (23) to pivot relative to the clamp means (20) to adjust the bottle holder and the support frame means (30) relative to an infant. Note that the knob (24*a*) is tightened to maintain the support means (30) in any pivotal position by friction. However, when a light force is applied such as when an infant bangs against the frame means (30), the frame means (30) will pivot to prevent injury to the infant. Further, the center of the ring (23*a*) is laterally offset in relation to the locking knob (22*a*) to permit access to the knob (22*a*) when the bar (24) extends to and below the knob (22*a*) as shown in FIG. 4. Note also that the height of the frame means (30) can be adjusted in relation to the seat by sliding the side bars (34) in the rings (23) and clamping the bars (34) at any position therealong.

Figure 5:
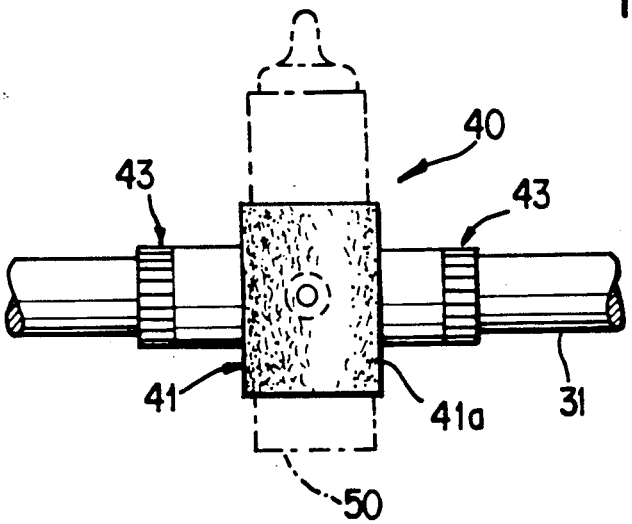
FIG. 5 is a top view of the bottle holder.

FIG. 5 shows a top view of the bottle holder which comprises a semi-circular cross-sectioned bottle cradle (41) for resting or frictionally locking a bottle (50) thereto. The surface of the cradle (41) is preferably one side of a Velcro connection. By providing a tubular sleeve made of the other side of a Velcro connection, which is slipped into the bottle (50), the bottle can be frictionally locked to the cradle (41) . The cradle (41) can be integral with a tubular body (42) or preferably, the cradle (41) can be pivotally attached to the tubular body (42) to enable the cradle to be detached therefrom and also permit the cradle to rotate relative to the body (42) using conventional means to accomplish the same.

Figure 6:
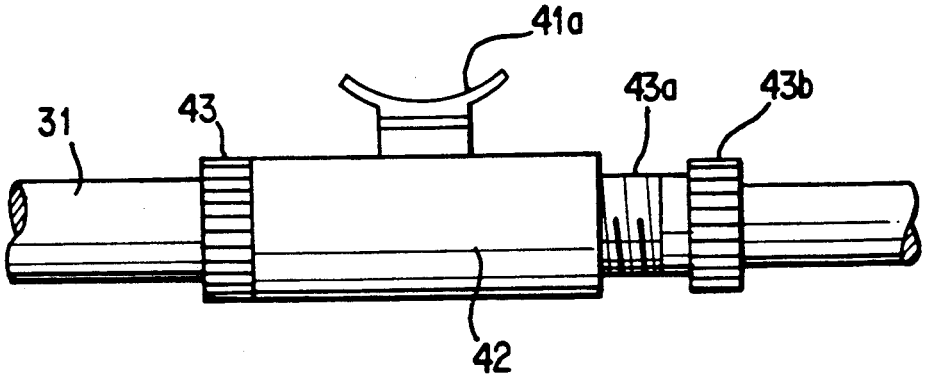
FIG. 6 is a front view of the bottle holder showing a detailed view of the locking mechanism thereof.

FIG. 6 shows a detailed view of the bottle holder. Each end of the body (42) has a locking means (43) to enable the holder (40) to be position anywhere along the central bar means (31). Specifically the locking means (43) comprises a threaded portion (43*a*) integral with the body (42) and having slits (not shown) running in the longitudinal direction of the body (42) and a threaded knob (43*b*). By tightening the knob, the body (42) is prevented from sliding and rotating relative to the central bar. By loosely tightening the knobs (44*b*), the bottle can rotate and slide relative to the central bar means (31) with enough friction as maintain the holder (40) in any position along the bar means (31). Such a locking means is conventional.

The foregoing is considered as illustrative of the principles of my invention. Numerous modifications can be expediently made as recognized by those skilled in the art. Therefore, it is not desired to limit my invention to the exact construction as illustrated and described. Accordingly, all expedient modifications may be made within the scope of my invention.

I claim:

1. A device for mounting an object holding means removably to an infant supporting means, including an infant seat, an infant car seats, and the like, comprising:

an adjustable support frame means for stably holding said object holding means, comprising:

a first side bar with a pair of ends;

a central bar with a pair of ends;

a second side bar with a pair of ends; and a pair of linkage means, each with locking means, wherein one of said linkage means pivotally connecting one end of said first side bar and one end of said central bar, the other linkage means pivotally connecting one end of said second side bar and the other end of said central bar, and said locking means locking said first side bar relative to said central bar and said second side bar relative to said central bar; and a clamping means for adjustably and removably attaching at least one of said first and said second side bars thereto and said clamping means being readily detachable and attachable to at least one side of said infant supporting means, whereby said pair of linkage means and said locking means permit said first and said second side bars to be laterally adjustable and permit said first and said second side bars to be folded substantially parallel to said central bar for stowing said device, and said device being detachable and attachable to any infant supporting means so that the same device is usable on any infant supporting means regardless of the variations in the dimension of the supporting means.

2. A device according to claim 1, wherein said object holding means is an infant bottle holder.

3. A device according to claim 1, wherein said adjustable support frame means is adjustable relative to said supporting means and thus, relative to an infant supported therein to accommodate for the variations in the size of infants.

4. A device according to claim 1, wherein said first side bar, said second side bar, and said central bar, and said pair of linkage means form a generally inverted U-shape when mounted to said clamping means, the other ends of said first and said second side bars being adjustably mounted to a pair of said clamping means.

5. A device according to claim 4, wherein said object holding means is adjustably slidable and lockable from rotational and lateral movement along said central bar so that said object holding means is positionable relative to an infant seating on said infant supporting means.

6. A device according to claim 1, wherein one of said first and said second side bars is detachable from said central bar for attaching the other of said first and said second side bars to said clamping means.

7. A device according to claim 1, wherein one of said first and said second side bars is foldable substantially parallel to said central bar for attaching the other of said first and said second side bars to said clamping means.

8. A device according to claim 6, wherein said central bar is pivotable relative to said one of said first and said second side bars and lockable at any selected position with said locking means.

9. A device according to claim 7, wherein said central bar is pivotable relative to said one of said first and said second side bars and lockable at any selected position with said locking means.

10. A device according to claim 6, wherein said one of said first and said second side bars is pivotable about its longitudinal axis and about an axis which is perpendicular to said longitudinal axis, and lockable at any selected position by said clamping means.

11. A device according to claim 7, wherein said one of said first and said second side bars is pivotable about its longitudinal axis and about an axis which is perpendicular to said longitudinal axis, and lockable at any selected position by said clamping means.

12. A device according to claim 8, wherein said one of said first and said second side bars is pivotable about its longitudinal axis and about an axis which is perpendicular to said longitudinal axis, and lockable at any selected position by said clamping means.

13. A device according to claim 9, wherein said one of said first and said second side bars is pivotable about its longitudinal axis and about an axis which is perpendicular to said longitudinal axis, and lockable at any selected position by said clamping means.

14. A device according to claim 1, wherein said clamping means comprises a pair of clamps for attaching said first and said second side bars are to sides of said infant supporting means.

15. A device according to claim 14, wherein said central bar is adjustable so that said central bar is positioned horizontal regardless of differences in height of said sides of said infant supporting means.

16. A device according to claim 4, wherein said central bar is adjustable so that said central bar is positioned horizontal regardless of differences in height of said sides of said infant supporting means.

17. A device according to claim 4, wherein said clamping means and/or said adjustable supporting means is released from its position upon an impact to prevent injury to an infant when said infant hits said device.

* * * * *